US012108896B2

(12) United States Patent
Oksman

(10) Patent No.: US 12,108,896 B2
(45) Date of Patent: Oct. 8, 2024

(54) SYSTEMS AND METHODS FOR DISTRIBUTING PARCELS

(71) Applicant: BOKS, Toulouse (FR)

(72) Inventor: Adrien Oksman, Paris (FR)

(73) Assignee: BOKS, Toulouse (FR)

( * ) Notice: Subject to any disclaimer, the term of this patent is extended or adjusted under 35 U.S.C. 154(b) by 313 days.

(21) Appl. No.: 17/614,160

(22) PCT Filed: Jun. 1, 2020

(86) PCT No.: PCT/EP2020/065120
§ 371 (c)(1),
(2) Date: Nov. 24, 2021

(87) PCT Pub. No.: WO2020/240038
PCT Pub. Date: Dec. 3, 2020

(65) Prior Publication Data

US 2022/0202224 A1 Jun. 30, 2022

(30) Foreign Application Priority Data

May 31, 2019 (FR) ..... 1905819

(51) Int. Cl.
*A47G 29/14* (2006.01)

(52) U.S. Cl.
CPC ..... *A47G 29/141* (2013.01); *A47G 2029/149* (2013.01)

(58) Field of Classification Search
CPC ..... A47G 29/141; A47G 2029/149; G07C 9/00912; G07C 9/00896; G06Q 10/0836
See application file for complete search history.

(56) References Cited

U.S. PATENT DOCUMENTS 10,719,804 B1 * 7/2020 Lundahl ..... G07C 9/00896
11,166,580 B2 * 11/2021 Waisanen ..... A47G 29/20
(Continued)

FOREIGN PATENT DOCUMENTS

DE 102014105264 10/2015
GB 2443212 A 12/2006
(Continued)

OTHER PUBLICATIONS

International Search Report dated Aug. 19, 2020.

*Primary Examiner* — William L Miller
(74) *Attorney, Agent, or Firm* — IPSILON USA, LLP

(57) ABSTRACT

The invention relates to a system (100) and a method (200, 300) for distributing parcels, comprising:

at least one locker (110) for receiving parcels, including:
- a first processor (115) for controlling the locking/unlocking of an access door (111) according to a control signal, at least one portable electronic device (120) including:
- a second processor (124) for generating the control signal, the control signal comprising at least one opening code associated with a parcel previously ordered from a commercial site by the user, wherein the first processor (115) is further configured to:

unlock an access door (111) when the user places the portable electronic device (120) close to the parcel receiving locker (110) such that a first short-range wireless transceiver (114) and a second short-range wireless transceiver (123) interface so as to form a short-range local area network (10), and prevent subsequent unlocking of the access door (111) with previously used opening codes.

13 Claims, 4 Drawing Sheets

(56) References Cited

U.S. PATENT DOCUMENTS

| | | | | |
|---|---|---|---|---|
| 2015/0099508 | A1* | 4/2015 | Lax | A47G 29/30 455/420 |
| 2015/0102903 | A1* | 4/2015 | Wilkinson | A47G 29/141 340/5.61 |
| 2015/0356801 | A1* | 12/2015 | Nitu | G07F 9/001 340/5.61 |
| 2016/0247344 | A1* | 8/2016 | Eichenblatt | G07C 9/00896 |
| 2017/0124510 | A1* | 5/2017 | Caterino | A47G 29/141 |
| 2017/0262800 | A1* | 9/2017 | Dorpfeld | G06Q 10/08 |
| 2017/0286905 | A1 | 10/2017 | Richardson et al. | |
| 2018/0070753 | A1* | 3/2018 | Eveloff | H04W 4/025 |
| 2018/0158021 | A1 | 6/2018 | Dautz et al. | |
| 2019/0307278 | A1* | 10/2019 | Henneli | G07C 9/00 |
| 2019/0318557 | A1* | 10/2019 | Amuduri | G06Q 50/12 |
| 2021/0321807 | A1* | 10/2021 | Needler | G07C 9/00912 |
| 2022/0079366 | A1* | 3/2022 | Cotton-Betteridge | G06Q 10/0832 |

FOREIGN PATENT DOCUMENTS

| | | |
|---|---|---|
| JP | 2002128227 | 5/2002 |
| JP | 2002324198 | 11/2002 |
| JP | 2004514074 | 5/2004 |
| JP | 2018159229 | 10/2018 |
| JP | 2019037389 | 3/2019 |

* cited by examiner

SYSTEMS AND METHODS FOR DISTRIBUTING PARCELS

RELATED APPLICATION

This application is a National Phase of PCT/EP2020/065120 filed on Jun. 1, 2020, which claims the benefit of priority from French Patent Application No. 19 05819, filed on May 31, 2019, the entirety of which are incorporated by reference.

TECHNICAL FIELD

The invention relates to a system for distributing parcels as well as methods for delivering and receiving a parcel in this system.

PRIOR ART

Receiving a parcel is often laborious, particularly for people who live in an apartment block. In fact, typically a postman or delivery person delivers the parcel during office hours, when the addressee of the parcel is not at home. And since the postman or delivery person cannot leave the parcel in front of the door of the addressee so as to prevent it from being stolen, he/she must return the parcel to the post office or a parcel pick-up/drop-off point which the addressee must go to in order to collect the parcel, within a set time frame.

To solve this problem, FR3057451 is known which discloses a shared parcel box which does not require electric cabling and which can be shared among inhabitants of an apartment block. Such a solution allows the inhabitants of the apartment block to collect their parcels at any time of the day.

However, this solution requires that the delivery person be registered on a remote server by inputting his mobile telephone number. The remote server is then able to send codes for opening the parcel box to the delivery person when he/she is in front of the shared parcel box. This arrangement means that only those delivery people registered on the remote server can deliver parcels into the shared parcel boxes.

This solution is not adapted to take into account all of the entities involved in the parcel distribution market.

There is thus a need for a system for distributing parcels which functions with all parcel delivery people.

SUMMARY OF THE INVENTION

The invention aims to overcome these disadvantages.

Therefore, the invention relates to a system for distributing parcels, which comprises:

at least one locker for receiving parcels, including:
- an access door,
- a lock for locking/unlocking the access door,
- a first memory for storing a plurality of locker opening codes associated with the parcel receiving locker,
- a first short-range wireless transceiver to receive a control signal,
- a first processor for controlling the locking/unlocking of the access door according to the control signal, at least one portable electronic device configured to be controlled by a user's touch, the portable electronic device including:
- at least one contact surface,
- a software module for managing the parcel receiving locker and interfaced with the contact surface (121), a second memory,
- a second short-range wireless transceiver for transmitting the control signal,
- a second processor for generating the control signal in response to the establishment of a touch between the user and at least one predetermined area of the contact surface, the control signal comprising at least one user opening code associated with a parcel previously ordered from a commercial site by the user, the user opening code being generated by the software module for managing the parcel receiving locker when the parcel was ordered, wherein the first processor is further configured to:

unlock the access door in response to a match between the user opening code and one of the locker opening codes when the user places the portable electronic device close to the parcel receiving locker such that the first short-range wireless transceiver and the second short-range wireless transceiver interface so as to form a short-range local area network, and prevent subsequent unlocking of the access door with previously used opening codes.

In a first particular embodiment:

the first memory is further configured to store a plurality of delivery codes associated with the parcel receiving locker, the lock further comprises a device for manually inputting a delivery code able to unlock the access door, the first processor is further configured to:
- prevent subsequent unlocking of the access door with previously used delivery codes, and
- unlock the access door when the opening code in the control signal is not one of the previously used opening codes and the delivery code input, by the parcel delivery person, on the manual inputting device is one of the previously used delivery codes.

In a second particular embodiment, the first processor comprises a pseudo random generator to generate the plurality of opening codes and the plurality of delivery codes, according to a seed value uniquely associated with the parcel receiving locker.

In one example of the second particular embodiment, the second processor comprises a pseudo random generator to generate at least one delivery code according to the seed value uniquely associated with the parcel receiving locker.

In a third particular embodiment, when the system is activated:

the second processor is further configured to control the transmission of the seed value to the parcel receiving locker via the short-range local area network, in response to the establishment of a touch between the user and at least one predetermined area of the contact surface, and the first processor is further configured to store the seed value in the first memory.

In a fourth particular embodiment, the portable electronic device further comprises a first long-range wireless transceiver to receive an update signal, the system further comprising a remote server, the remote server comprising:
- a second long-range wireless transceiver to transmit the update signal, and
- a third processor to:
  - generate at least one replacement code associated with the parcel receiving locker and intended to replace at least one previously used opening code or at least one previously used delivery code, and in response to receiving an update request, generate the update signal, the update signal comprising the replacement code, wherein, when unlocking the access door, the second processor is further configured to:

interface the first long-range wireless transceiver with the second long-range wireless transceiver so as to form a long-range local area network, the first processor is further configured to:

control the transmitting of the update request to the remote server, via the short-range local area network and then via the long-range local area network, and replace all or some of the previously used opening codes according to the update signal.

In one example of the fourth particular embodiment, the second memory is configured to store the replacement code when waiting for the reformation of the short-range local area network when it is unavailable.

In a fifth particular embodiment, the second memory is further configured to store the update request when waiting for the reformation of the long-range local area network when it is unavailable.

In a sixth particular embodiment, the third processor comprises a pseudo random generator to generate the replacement code according to the seed value uniquely associated with the parcel receiving locker.

In a seventh particular embodiment, the first short-range wireless transceiver and the second short-range wireless transceiver use a protocol selected from: Bluetooth, Bluetooth Low Energy, Wifi Low Power, Wifi direct and NFC.

In an eighth particular embodiment, the first long-range wireless transceiver and the second long-range wireless transceiver use a protocol selected from: mobile telecommunication network protocols, Wifi.

The invention likewise relates to a method for delivering a parcel in a system in accordance with the invention. The method comprises:

a step of ordering on a commercial site, a step of generating a delivery code with the portable electronic device, a step of entering, on the commercial site, the delivery code in a field for the delivery address to which the parcel associated with the order will be delivered, a step of opening, by a delivery person, the parcel receiving locker using the manual inputting system and the delivery code entered in the field for the delivery address for the parcel, a step of depositing the parcel in the unlocked parcel receiving locker, and a step of closing the parcel receiving locker.

The invention also relates to a method for receiving a delivered parcel in a system in accordance with the invention. The method comprises:

a step of establishing a touch between the user and at least one predetermined area of the contact surface of the portable electronic device so as to generate the control signal, a step of unlocking the access door in response to the user placing the portable electronic device close to the parcel receiving locker such that the portable electronic device and the parcel receiving locker interface so as to form a short-range local area network, a step of removing the parcel.

The figures are not necessarily drawn to scale, in particular in terms of thickness, this being for illustrative purposes.

DESCRIPTION OF EMBODIMENTS

Figure 1:
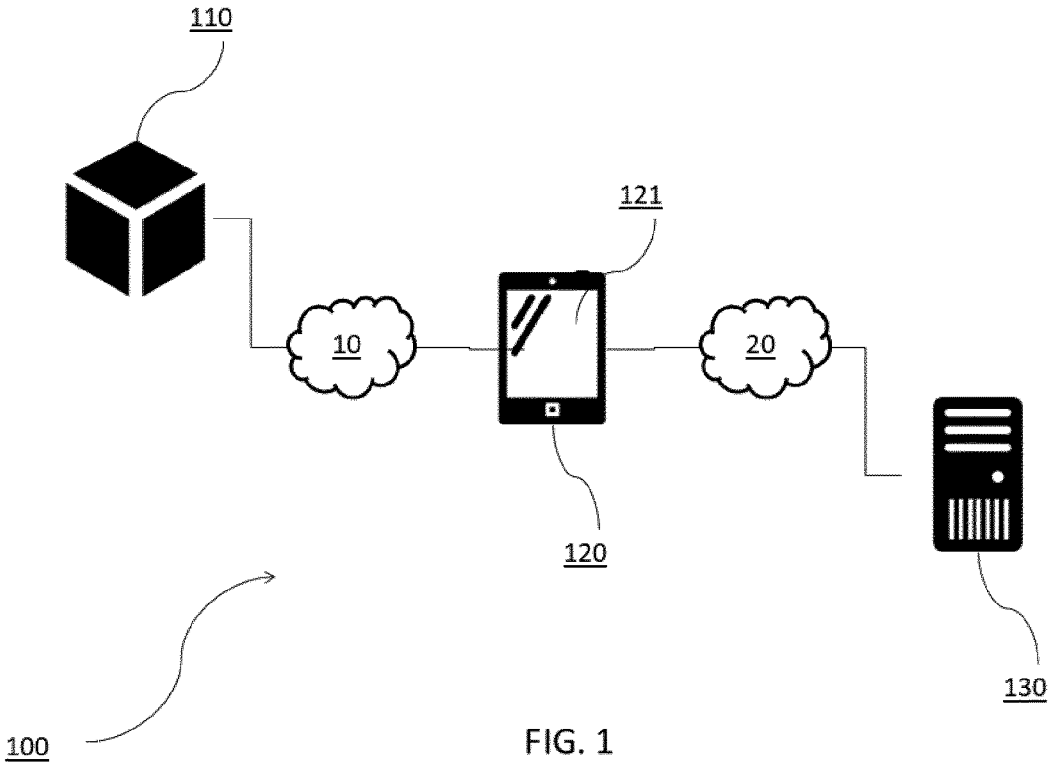
FIG. 1 shows a system for distributing parcels in accordance with the invention.

FIG. 1 illustrates a system 100 for distributing parcels which comprises at least one parcel receiving locker 110 and at least one portable electronic device 120.

In the invention, the parcel receiving locker 110 is configured to receive a parcel previously ordered on a commercial site by a user. In one example, the parcel comprises at least one product sold on the commercial site. In another example, the commercial site is an Internet site having an Internet address of a known type.

Furthermore, in the invention the portable electronic device 120 is configured to be controlled by a user's touch. In one example, the portable electronic device 120 is a smartphone, a tablet or a smartwatch.

Figure 2:
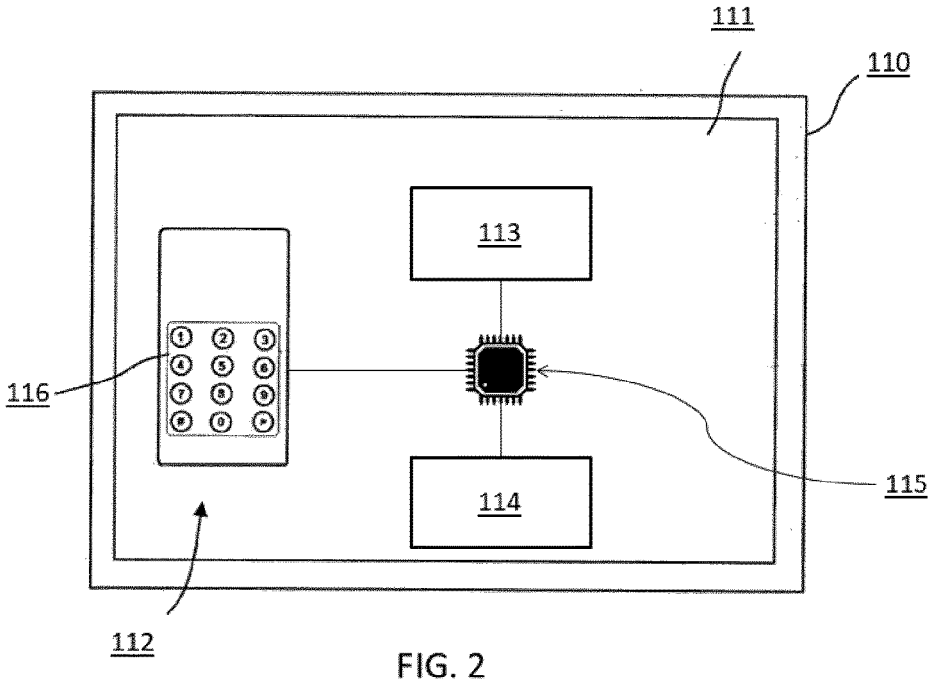
FIG. 2 shows a parcel receiving locker in accordance with the invention.

In FIGS. 1 and 2, the parcel receiving locker 110 comprises means of a type known per se. In particular, the parcel receiving locker 110 comprises an access door 111, a lock 112, a first memory 113, a first short-range wireless transceiver 114 and a first processor 115.

The access door 111 is configured to block an opening of the parcel receiving locker 110 which allows access to an interior space of the parcel receiving locker 110.

The lock 112 is configured to lock/unlock the access door 111.

The first memory 113 is configured to store a plurality of opening codes associated with the parcel receiving locker 110.

The first short-range wireless transceiver 114 is configured to receive a control signal.

In the description, the phrase "short-range" is understood to mean a centimetre range, i.e. a few centimetres or tens of centimetres.

In one example, the first short-range wireless transceiver 114 uses a protocol selected from: Bluetooth, Bluetooth Low Energy, Wifi Low Power, Wifi direct and NFC. Therefore, depending upon the protocol chosen, a step of prior pairing may be necessary.

Returning to FIG. 2, the first processor 115 is configured to control the locking/unlocking of the access door 111 according to the control signal.

In fact, in the invention the control signal comprises at least one opening code associated with a parcel previously ordered on a commercial site by the user. Therefore, the first processor 115 can compare the opening code in the control signal with the plurality of opening codes associated with the parcel receiving locker 110. If they match, the first processor 115 unlocks the access door 111.

Furthermore, the unlocking mechanism is the same when the control signal comprises several opening codes, each opening code being associated with a parcel previously ordered on a commercial site by the user. In fact, in this case the first processor 115 unlocks the access door 111 in the event of a match between one of the opening codes in the control signal and the plurality of opening codes associated with the parcel receiving locker 110.

Figure 3:
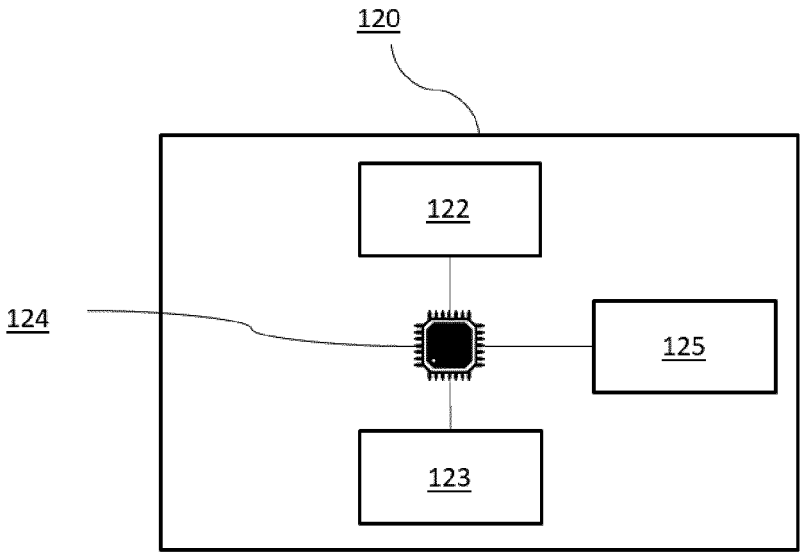
FIG. 3 shows a portable electronic device in accordance with the invention.

In FIGS. 1 and 3, the portable electronic device 120 comprises means of a type known per se. In particular, the portable electronic device 120 comprises at least one contact surface 121, a second memory 122, a second short-range wireless transceiver 123 and a second processor 124.

The contact surface 121 is able to receive a user's touch. In one example, the contact surface 121 is a button of the portable electronic device 120. In another example, the contact surface 121 is a touch-screen of the portable electronic device 120. In every case, the second processor 124 is configured to execute a software module for managing the parcel receiving locker 110, interfaced with the contact surface 121. In this manner, the software module can detect the user's touch on the contact surface 121.

Returning to FIG. 3, the second memory 122 is of the same type as the first memory 113.

The second short-range wireless transceiver 123 is of the same type as the first short-range wireless transceiver 114. In contrast, the second short-range wireless transceiver 123 is configured to transmit the control signal.

The second processor 124 is configured to generate the control signal in response to the establishment of a touch between the user and at least one predetermined area of the contact surface 121.

In the invention, the first processor 115 is further configured to unlock the access door 111 when the user places the portable electronic device 120 close to the parcel receiving locker 110 such that the first short-range wireless transceiver 114 and the second short-range wireless transceiver 123 interface so as to form a short-range local area network 10. In one particular embodiment, the portable electronic device 120 and the parcel receiving locker 110 form the short-range local area network 10 when the distance between them is less than a predetermined distance.

Therefore, in the invention unlocking of the access door 111 is caused after a series of events. Firstly, the user presses against a predetermined area of the contact surface 121 to generate a control signal which is transmitted by the first short-range wireless transceiver 114. Then, the short-range local area network 10 is formed by the portable electronic device 120 being placed sufficiently close to the parcel receiving locker 110. Finally, the control signal passes through the short-range local area network 10 to the first processor 115 which unlocks the access door 111 according to the control signal.

Furthermore, in the invention the first processor 115 is further configured to prevent subsequent unlocking of the access door 111 with previously used opening codes.

Therefore, in principle an opening code cannot be reused.

However, in one particular embodiment the first processor 115 prevents unlocking of the access door 111 with previously used opening codes so long as all of the codes of the plurality of opening codes associated with the parcel receiving locker 110 have not been used. Then, the same plurality of opening codes can be reused.

In another particular embodiment, the first processor 115 prevents unlocking of the access door 111 with previously used opening codes until a predetermined time period following the use of all of the codes of the plurality of opening codes associated with the parcel receiving locker 110 has expired. Then, the same plurality of opening codes can be reused.

In a first embodiment of the invention, a person delivering the parcel can unlock the parcel receiving locker 110 in order to place the parcel therein.

In this case, the first memory 113 is further configured to store a plurality of delivery codes associated with the parcel receiving locker 110.

In practice, the opening codes and the delivery codes are mutually linked codes such that each opening code is linked with a single delivery code and each delivery code is linked with a single opening code.

To this end, for example, the first processor 115 can comprise a pseudo random generator to generate the plurality of opening codes and the plurality of delivery codes, according to a seed value uniquely associated with the parcel receiving locker 110. Furthermore, the second processor 124 can comprise a pseudo random generator to generate at least one delivery code according to the seed value uniquely associated with the parcel receiving locker 110.

In one particular embodiment of the example, the seed value is installed in the first memory 113 of the parcel receiving locker 110 via the short-range local area network when activating the parcel receiving locker 110. In this case, the seed value is previously installed in the second memory 122 of the portable electronic device 120. In one example, the seed value is contained in an SMS or e-mail previously received by the portable electronic device 120.

In practice, the second processor 124 is further configured to control the transmission of the seed value to the first memory 113 of the parcel receiving locker 110 via the short-range local area network 10, in response to the establishment of a touch between the user and at least one predetermined area of the contact surface 121. Furthermore, the first processor 115 is configured to store the seed value in the first memory 113.

Furthermore, in the first embodiment of the invention, as shown in FIG. 2, the lock 112 further comprises a device 116 for manually inputting a delivery code able to unlock the access door 111. In one example, the manual inputting device 116 is a keyboard of a known type.

In the invention, the user generates the delivery code with the portable electronic device 120. To this end, as indicated above, the user can use the software module for management of the parcel receiving locker 110 executed by the second processor 124. Then, the user enters—on the commercial site—the delivery code in the field for the delivery address to which the parcel associated with the order will be delivered. In fact, the commercial site requires that the user provides his delivery address for the ordered parcel in the conventional manner. In one example of the invention, it is proposed to include the delivery code in the delivery address. In this manner, the system 100 does not need to identify the delivery person and the delivery person does not need to register with the system 100. However, in one particular embodiment the user can likewise send the delivery code to the delivery person by telephone, SMS, e-mail or a predetermined communications interface of the delivery person.

Thereafter, in the first embodiment of the invention the first processor 115 is further configured to prevent subsequent unlocking of the access door 111 with previously used delivery codes. In this case, the first processor 115 uses the same mechanism as for the previously used opening codes Furthermore, in the first embodiment of the invention, the first processor 115 is configured to unlock the access door 111 when the opening code in the control signal is not one of the previously used opening codes and the delivery code input, by the parcel delivery person, on the manual inputting device 116 is one of the previously used delivery codes.

Therefore, it is only after a delivery person has delivered a parcel that the user can unlock the access door 111. With this arrangement, the user can regularly verify whether an ordered parcel has been delivered in the parcel receiving locker 110 by attempting to unlock it. In this case, if the access door 111 opens, this means that a parcel has been delivered. If the door does not open, this means that a parcel has not been delivered.

In a second embodiment of the invention, all or some of the plurality of opening codes and of the plurality of delivery codes are updated via a remote server.

In the second embodiment of the invention, the portable electronic device 120 further comprises a first long-range wireless transceiver 125 to receive an update signal.

In the invention, the update signal comprises a replacement code associated with the parcel receiving locker 110, which is intended to replace at least one previously used opening code or at least one previously used delivery code.

In the description, the phrase "long-range" is understood to mean a hectometre range, i.e. several hundred metres to several kilometres.

In one example, the first long-range wireless transceiver 125 and the second long-range wireless transceiver 131 use a protocol selected from: mobile telecommunication network protocols (2G, 3G, 4G or 5G for example), Wifi.

In the second embodiment of the invention, the system 100 further comprises a remote server 130 of a known type.

Figure 4:
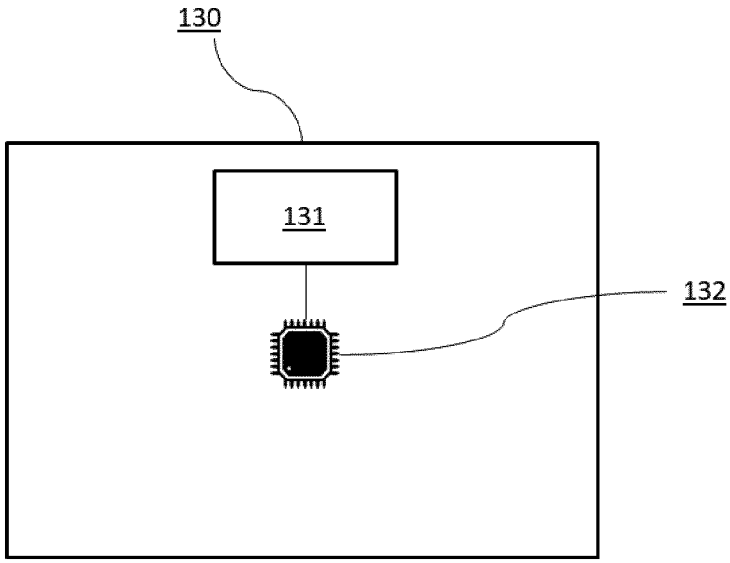
FIG. 4 shows a remote server in accordance with the invention.
Figure 5:
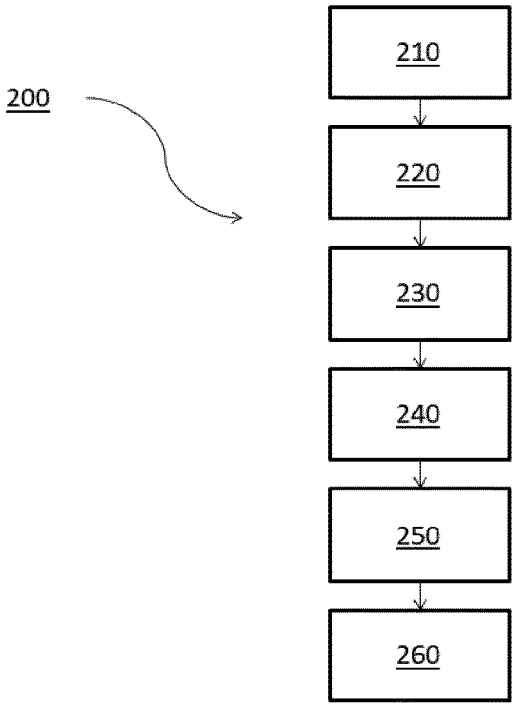
FIG. 5 shows a method for delivering a parcel in the system of FIG. 1.
Figure 6:
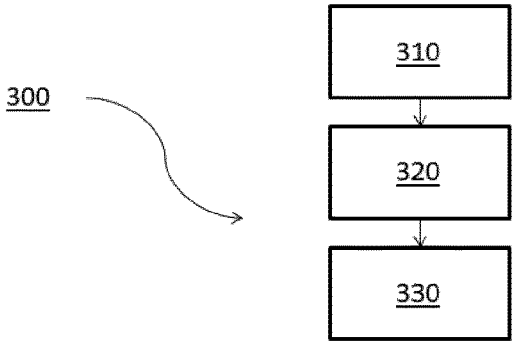
FIG. 6 shows a method for receiving a parcel in the system of FIG. 1.

As shown in FIG. 4, the remote server 130 comprises a second long-range wireless transceiver 131 and a third processor 132.

The second long-range wireless transceiver 131 is of the same type as the first long-range wireless transceiver 125. In contrast, the second long-range wireless transceiver 131 is configured to transmit the update signal.

The third processor 132 is configured to generate at least one replacement code.

In one particular embodiment, the third processor 132 comprises a pseudo random generator to generate the replacement code according to the seed value uniquely associated with the parcel receiving locker 110.

Furthermore, the third processor 132 is configured to generate the update signal in response to receiving an update request. In the invention, the update request is a signal which comprises predetermined information which the third processor 132 interprets as a request for updating all or some of the plurality of opening codes and of the plurality of delivery codes.

In the second embodiment of the invention, all of some of the plurality of opening codes and of the plurality of delivery codes are updated when unlocking the access door 111.

In practice, the second processor 124 is further configured to interface the first long-range wireless transceiver 125 with the second long-range wireless transceiver 131 so as to form a long-range local area network 20.

Thereafter, the first processor 115 is further configured to control the transmission of the update request to the remote server via the short-range local area network 10 and then via the long-range local area network 20.

Finally, the first processor 115 is further configured to replace all or some of the previously used opening codes according to the update signal.

Therefore, in the invention the portable electronic device 120 is used as a transceiver relay for updating the opening and/or delivery codes. In this manner, the parcel receiving locker 110 does not need to be fitted with long-range communication means which are very power-consuming. The parcel receiving locker 110 can thus be supplied with power via a cell or battery pack.

In one particular embodiment, it is envisaged that the short-range local area network or the long-range local area network may be unavailable.

For example, the interruption in the short-range local area network may be due to the fact that the distance between the portable electronic device 120 and the parcel receiving locker 110 is greater than a predetermined distance. Furthermore, the interruption in the long-range local area network may be due to the portable electronic device 120 being in an area with no radio coverage.

Thus, if the short-range local area network is unavailable the second memory 122 is configured to store the replacement code when waiting for the reformation of the short-range local area network.

Furthermore, if the long-range local area network is unavailable the second memory 122 is configured to store the update request when waiting for the reformation of the long-range local area network.

The invention likewise relates to a method 200 for delivering a parcel in the system 100.

In step 210, a user places an order on a commercial site.

In step 220, the user generates a delivery code with the portable electronic device 120. To this end, as indicated above, the user can use the software module for management of the parcel receiving locker 110 executed by the second processor 124.

In step 230, the user enters—on the commercial site—the delivery code in the field for the delivery address to which the parcel associated with the order will be delivered.

In step 240, a delivery person opens the parcel receiving locker 110 using the manual inputting system and the delivery code entered in the field for the delivery address for the parcel.

In fact, in the invention the delivery person does not need to be known to the system 100 in order to unlock the parcel receiving locker 110 and to place the parcel therein.

In step 250, the delivery person places the parcel in the unlocked parcel receiving locker 110.

Finally, in step 260 the parcel receiving locker is closed. In a first example, the parcel receiving locker is manually closed. In a second example, the first processor 115 is configured to close and lock the access door 111 after a predetermined time interval following unlocking of the access door 111 by the delivery person.

The invention also relates to a method 300 for receiving a delivered parcel in the system 100.

In step 310, the user presses against at least one predetermined area of the contact surface 121 of the portable electronic device 120 so as to generate the control signal.

In step 320, the user unlocks the access door 111 by placing the portable electronic device 120 close to the parcel receiving locker 110 such that the first short-range wireless transceiver 114 and the second short-range wireless transceiver 123 interface so as to form a short-range local area network 10.

Finally, in step 330 the user removes the parcel.

The invention has been shown with reference to the field of parcel delivery. However, the invention can likewise be used for returning parcels or even for delivering objects between individuals who live, for example, in the same apartment block or in the same neighbourhood. In this case, the user can send the delivery code to the other person by telephone, SMS or e-mail.

The invention can cover numerous variants and applications other than those described above. In particular, unless stated otherwise, the different structural and functional features of each of the embodiments described above do not have to be considered as being combined and/or closely and/or inextricably linked with each other, but in contrast considered as simple juxtapositions. Furthermore, the structural and/or functional features of the different embodiments described above can form, in their entirety or in part, any different juxtaposition or any different combination.

The invention claimed is:

1. A system for distributing parcels, comprising:

at least one locker for receiving parcels, including:

an access door, a lock for locking/unlocking the access door, a first memory for storing a plurality of locker opening codes associated with the parcel receiving locker, a first short-range wireless transceiver to receive a control signal, a first processor for controlling the locking/unlocking of the access door according to the control signal, at least one portable electronic device configured to be controlled by a user's touch, the portable electronic device including:

at least one contact surface, a software module for managing the parcel receiving locker and interfaced with the at least one contact surface, a second memory, a second short-range wireless transceiver for transmitting the control signal, a second processor for generating the control signal in response to the establishment of a touch between the user and at least one predetermined area of the contact surface, the control signal comprising at least one user opening code associated with a parcel previously ordered from a commercial site by the user, the user opening code being generated by the software module for managing the parcel receiving locker when the parcel was ordered, wherein the first processor is further configured to:

unlock the access door, in response to a match between the user opening code and one of the locker opening codes, when the user places the portable electronic device close to the parcel receiving locker such that the first short-range wireless transceiver and the second short-range wireless transceiver interface so as to form a short-range local area network, and prevent subsequent unlocking of the access door with previously used opening codes.

2. The system according to claim 1, wherein the first memory is further configured to store a plurality of delivery codes associated with the parcel receiving locker, the lock further comprises a device for manually inputting a delivery code able to unlock the access door, the first processor is further configured to:

prevent subsequent unlocking of the access door with previously used delivery codes, and unlock the access door when the opening code in the control signal is not one of the previously used opening codes and the delivery code input, by the parcel delivery person, on the manual inputting device is one of the previously used delivery codes.

3. The system according to claim 1, wherein the first processor comprises a pseudo random generator to generate a plurality of opening codes and the plurality of delivery codes, according to a seed value uniquely associated with the parcel receiving locker.

4. The system according to claim 3, wherein the second processor comprises a pseudo random generator to generate at least one delivery code according to the seed value uniquely associated with the parcel receiving locker.

5. The system according to claim 3, wherein, when activating the system, the second processor is further configured to control the transmission of the seed value to the parcel receiving locker via the short-range local area network, in response to the establishment of a touch between the user and at least one predetermined area of the at least one contact surface, and the first processor is further configured to store the seed value in the first memory.

6. The system according to claim 1, wherein the portable electronic device further comprises a first long-range wireless transceiver to receive an update signal, the system further comprising a remote server, the remote server comprising:

a second long-range wireless transceiver to transmit the update signal, and a third processor to:

generate at least one replacement code associated with the parcel receiving locker and intended to replace at least one previously used opening code or at least one previously used delivery code, and in response to receiving an update request, generate the update signal, the update signal comprising the replacement code, wherein, when unlocking the access door, the second processor is further configured to:

interface the first long-range wireless transceiver with the second long-range wireless transceiver so as to form a long-range local area network, the first processor is further configured to:

control the transmitting of the update request to the remote server, via the short-range local area network and then via the long-range local area network, and replace all or some of the previously used opening codes according to the update signal.

7. The system according to claim 6, wherein the second memory is configured to store the replacement code when waiting for the reformation of the short-range local area network when it is unavailable.

8. The system according to claim 6, wherein the second memory is further configured to store the update request when waiting for the reformation of the long-range local area network when it is unavailable.

9. The system according to claim 6, wherein the first processor comprises a pseudo random generator to generate the plurality of opening codes and a plurality of delivery codes, according to a seed value uniquely associated with the parcel receiving locker, and wherein the third processor comprises a pseudo random generator to generate the replacement code according to the seed value uniquely associated with the parcel receiving locker.

10. The system according to claim 6, wherein the first long-range wireless transceiver and the second long-range wireless transceiver use a protocol selected from: mobile telecommunication network protocols, and Wifi.

11. The system according to claim 1, wherein the first short-range wireless transceiver and the second short-range wireless transceiver use a protocol selected from: Bluetooth, Bluetooth Low Energy, Wifi Low Power, Wifi direct and NFC.

12. A method for delivering a parcel in the system according to claim 1, the method comprising:

ordering on a commercial site, generating a delivery code with the portable electronic device, entering on the commercial site, the delivery code in a field for the delivery address to which the parcel associated with the order will be delivered, opening, by a delivery person, the parcel receiving locker using a manual inputting system and the delivery code entered in the field for the delivery address for the parcel, depositing the parcel in the unlocked parcel receiving locker, and closing the parcel receiving locker.

13. The method for receiving a delivered parcel in the system according to claim 1, the method comprising:

establishing a touch between the user and at least one predetermined area of the at least one contact surface of the portable electronic device so as to generate the control signal, unlocking the access door in response to the user placing the portable electronic device close to the parcel receiving locker such that the portable electronic device and the parcel receiving locker interface so as to form the short-range local area network, removing the parcel.

* * * * *